US008511968B2

(12) United States Patent
Liang et al.

(10) Patent No.: US 8,511,968 B2
(45) Date of Patent: Aug. 20, 2013

(54) TURBINE VANE FOR A GAS TURBINE ENGINE HAVING SERPENTINE COOLING CHANNELS WITH INTERNAL FLOW BLOCKERS

(75) Inventors: George Liang, Palm City, FL (US); Nan Jiang, Jupiter, FL (US); Zhihong Gao, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 1145 days.

(21) Appl. No.: 12/540,410

(22) Filed: Aug. 13, 2009

(65) Prior Publication Data

US 2011/0038735 A1 Feb. 17, 2011

(51) Int. Cl.
*F01D 5/18* (2006.01)

(52) U.S. Cl.
USPC ..... 415/115

(58) Field of Classification Search
USPC ..... 415/115; 416/95, 96 R, 97 R
See application file for complete search history.

(56) References Cited

U.S. PATENT DOCUMENTS

| | | | | |
|---|---|---|---|---|
| 6,033,181 | A * | 3/2000 | Endres et al. | 416/97 R |
| 6,257,830 | B1 * | 7/2001 | Matsuura et al. | 416/96 R |
| 6,290,463 | B1 * | 9/2001 | Fargher et al. | 416/97 R |
| 6,508,620 | B2 * | 1/2003 | Sreekanth et al. | 415/115 |
| 6,902,372 | B2 | 6/2005 | Liang | |
| 6,932,573 | B2 | 8/2005 | Liang | |
| 6,981,846 | B2 | 1/2006 | Liang | |
| 7,090,461 | B2 | 8/2006 | Liang | |
| 7,118,337 | B2 | 10/2006 | Liang | |
| 7,137,779 | B2 | 11/2006 | Liang | |
| 7,137,780 | B2 | 11/2006 | Liang | |
| 7,150,601 | B2 * | 12/2006 | Pietraszkiewicz et al. | 416/97 R |
| 7,156,620 | B2 * | 1/2007 | Papple | 416/96 R |
| 7,189,060 | B2 | 3/2007 | Liang | |
| 7,217,097 | B2 | 5/2007 | Liang | |
| 7,281,895 | B2 | 10/2007 | Liang | |
| 7,296,972 | B2 | 11/2007 | Liang | |
| 7,303,376 | B2 | 12/2007 | Liang | |
| 7,390,168 | B2 | 6/2008 | Liang | |
| 7,413,407 | B2 | 8/2008 | Liang | |
| 7,435,053 | B2 | 10/2008 | Liang | |
| 7,458,778 | B1 | 12/2008 | Liang | |
| 7,473,073 | B1 | 1/2009 | Liang | |
| 7,481,622 | B1 | 1/2009 | Liang | |
| 7,481,623 | B1 | 1/2009 | Liang | |
| 7,520,725 | B1 | 4/2009 | Liang | |
| 7,527,474 | B1 | 5/2009 | Liang | |
| 7,527,475 | B1 | 5/2009 | Liang | |
| 7,530,789 | B1 | 5/2009 | Liang | |
| 7,534,089 | B2 | 5/2009 | Liang | |
| 7,537,431 | B1 | 5/2009 | Liang | |
| 2008/0170945 | A1 * | 7/2008 | Barrett | 416/96 R |

FOREIGN PATENT DOCUMENTS

JP 01066401 A * 3/1989

* cited by examiner

*Primary Examiner* — Nathaniel Wiehe
*Assistant Examiner* — Ryan Ellis

(57) ABSTRACT

A turbine vane for a gas turbine engine with an internal cooling system formed from a serpentine cooling channel with one or more flow blocking ribs is disclosed. The serpentine cooling channels may be configured to receive cooling fluids from internal cooling fluids supply channels. The serpentine cooling channels may include flow blocking ribs to form concurrent flow channels to reduce the cross-sectional area within the midchord region of the airfoil to maintain the internal through flow channel Mach number. The flow blocking ribs may include slots therein and may have any appropriate configuration. In at least one embodiment, the flow blocking ribs may be have a nonuniform taper or a uniformed taper.

16 Claims, 5 Drawing Sheets

TURBINE VANE FOR A GAS TURBINE ENGINE HAVING SERPENTINE COOLING CHANNELS WITH INTERNAL FLOW BLOCKERS

FIELD OF THE INVENTION

This invention is directed generally to gas turbine engines, and more particularly to turbine vanes for gas turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine vanes are exposed to high temperature combustor gases that heat the airfoil. The airfoils include an internal cooling system for reducing the temperature of the airfoils. While there exist many configurations of cooling systems, there exists a need for improved cooling of gas turbine vanes.

SUMMARY OF THE INVENTION

This invention is directed to a turbine vane for a gas turbine engine. The turbine vane may be configured to better accommodate high combustion gas temperatures than conventional vanes. In particular, the turbine vane may include an internal cooling system positioned within internal aspects of the vane. In at least one embodiment, at least a portion of the internal cooling system may be formed from a serpentine cooling channel including one or more flow blocker ribs extending generally lengthwise in the serpentine cooling channel. The flow blocker ribs may reduce the cross-sectional flow area and form two or more concurrent flow channels. Reducing the cross-sectional flow area increases the flow, thereby maintaining the through flow channel Mach number and preventing destructive localized hot spots in locations such as, but not limited to, the trailing edge.

The turbine vane may be formed from a generally elongated airfoil. The generally elongated airfoil may be formed from an outer wall and may have a leading edge, a trailing edge, a pressure side, a suction side generally opposite to the pressure side, a first endwall at a first end, a second endwall at a second end opposite the first end, and an internal cooling system positioned within the generally elongated airfoil. The internal cooling system may include at least one internal chamber positioned within the generally elongated airfoil. At least one serpentine cooling channel may be positioned in the internal chamber forming the internal cooling system. The serpentine cooling channel may be formed from at least a first pass, a second pass and a third pass. The first and third passes pass cooling fluids in the same direction that is generally opposite to the second pass that connects the first pass to the third pass. The first pass may be positioned closest to the leading edge, and the third pass may be positioned closest to the trailing edge. The second pass may include at least one flow blocker rib extending longitudinally within the second pass. The flow blocker rib may include a plurality of flow blocker slots.

The first, second and third passes may extend from an inner diameter (ID) to an outer diameter (OD) of the turbine vane. The flow blocker rib may extend from the ID to the OD or extend a shorter distance. The flow blocker may extend from the outer wall forming the pressure side to the outer wall forming the suction side. The third pass may include at least one flow blocker rib extending longitudinally within the third pass. In another embodiment, the first pass may include at least one flow blocker rib extending longitudinally within the first pass. In yet another embodiment, the first pass may include two flow blocker ribs extending longitudinally within the first pass, and the second pass may include two flow blocker ribs extending longitudinally within the second pass. A plurality of trailing edge cooling fluid exhaust orifices may extend from the third pass to the trailing edge.

The size and configuration of the flow blocker rib may be adapted to tailor the flow of cooling fluids through the serpentine cooling channel to maintain a target Mach number. The flow blocker rib may have a nonuniform width with a uniform taper. In another embodiment, the flow blocker rib may have a nonuniform width with a nonuniform taper. Each configuration may be used to tailor fluid flow for a particular application.

An advantage of the internal cooling system is that the use of flow blocker ribs in the serpentine cooling channel reduces the temperature increase of the cooling air in a long chord airfoil, thus maintaining a high cooling air potential for use in cooling the trailing edge of the airfoil.

Another advantage of the internal cooling system is that the flow blocker ribs provide additional stiffness to the airfoil, which eliminates the likelihood of suction side wall bulge.

Yet another advantage of the internal cooling system is that the use of the flow blocker ribs in a long chord triple pass serpentine cooling channel enables the airfoil to be kept at a uniform temperature, thereby achieving a balanced durable airfoil.

Another advantage of the internal cooling system is that use of the flow blocker rib in the triple pass serpentine channel enables large ceramic cores to be used, which in turn correlates to high casing yields.

Still another advantage of the turbine vane is that the flow blocker ribs enables fewer passes to be used in the long chord airfoil, yet adequately cool the airfoil.

Another advantage of the internal cooling system is that the flow blocker ribs create additional convective surface area thereby enhancing the overall airfoil cooling capability.

Yet another advantage of the internal cooling system is that flow blocker rib can be used to redistribute cooling fluids within the cooling passages by tapering the thickness of the flow blocker ribs.

Another advantage of the internal cooling system is that the flow blocker ribs break the vortices formed by the trip strips, which increases airfoil internal heat transfer enhancement level over that of the traditional long trip strip.

Still another advantage of the internal cooling system is that the flow blocker ribs provide a higher overall airfoil internal convective cooling enhancement with a reduction in airfoil cooling flow demand that translates into better turbine performance.

Another advantage of the internal cooling system is that the flow blocker ribs provide growth potential for the serpentine flow circuit to add cooling fluid flow or obtain a cooler airfoil trailing edge metal temperature.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

As shown in FIGS. 1-9, this invention is directed to a turbine vane 10 for a gas turbine engine. The turbine vane 10 may be configured to better accommodate high combustion gas temperatures than conventional vanes. In particular, the turbine vane 10 may include an internal cooling system 12 positioned within internal aspects of the vane 10. In at least one embodiment, at least a portion of the internal cooling system 12 may be formed from a serpentine cooling channel 14 including one or more flow blocker ribs 16 extending generally lengthwise in the serpentine cooling channel 14. The flow blocker ribs 16 may reduce the cross-sectional flow area and form two or more concurrent flow channels. Reducing the cross-sectional flow area increases the flow, thereby maintaining the through flow channel Mach number and preventing destructive localized hot spots such as, but not limited to, in the trailing edge.

Figure 1:
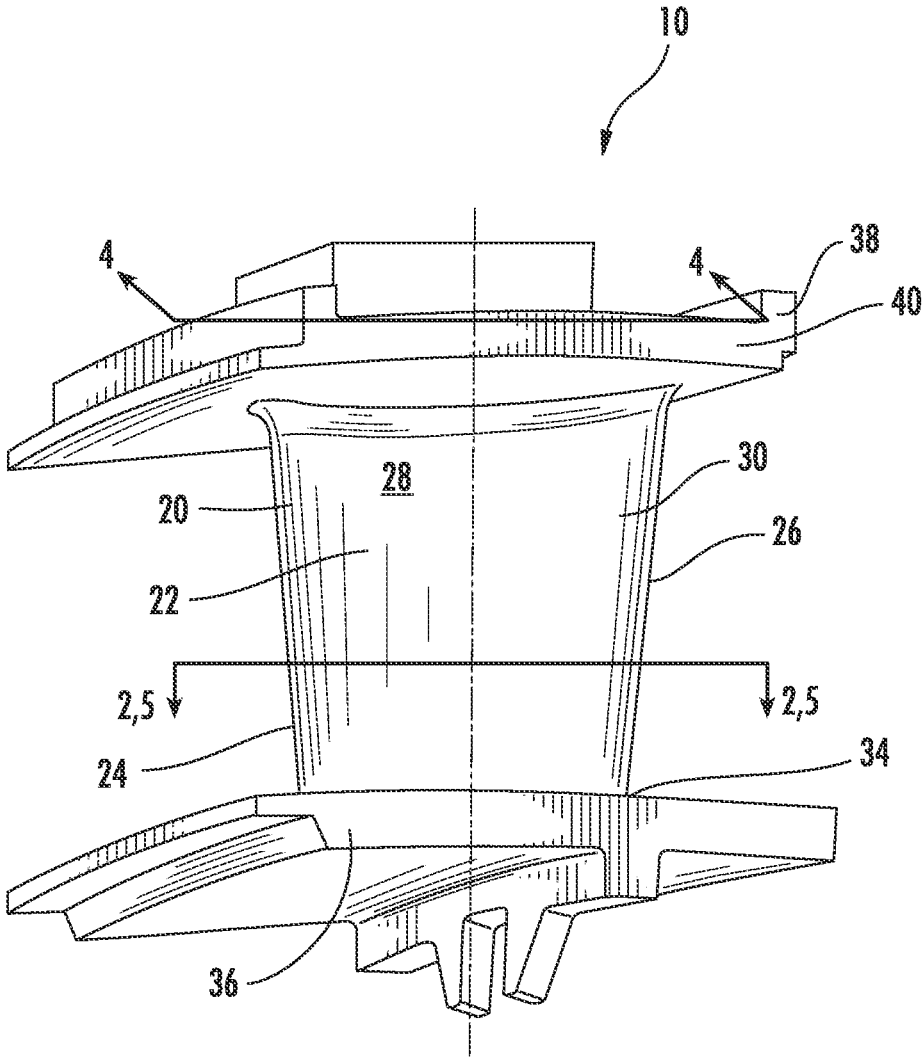
FIG. 1 is a perspective view of a turbine vane with aspects of this invention.
Figure 2:
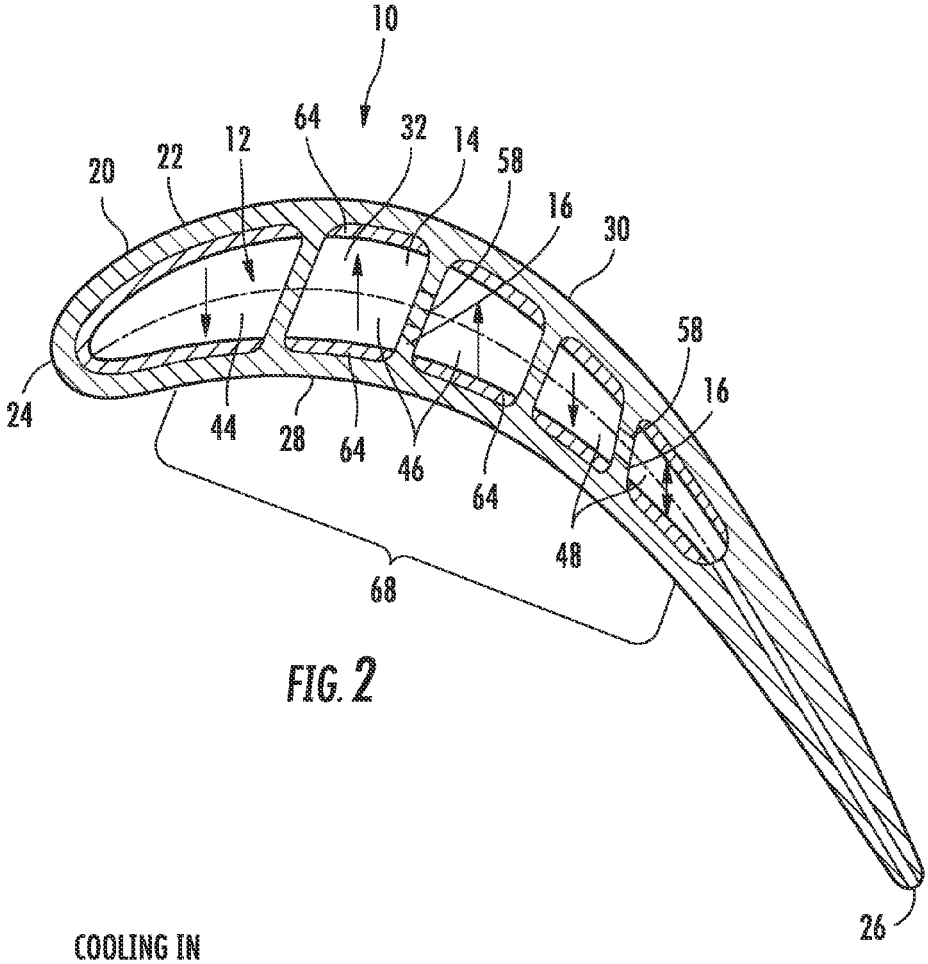
FIG. 2 is a cross-sectional view of the turbine vane taken at section line 2-2 in FIG. 1.
Figure 4:
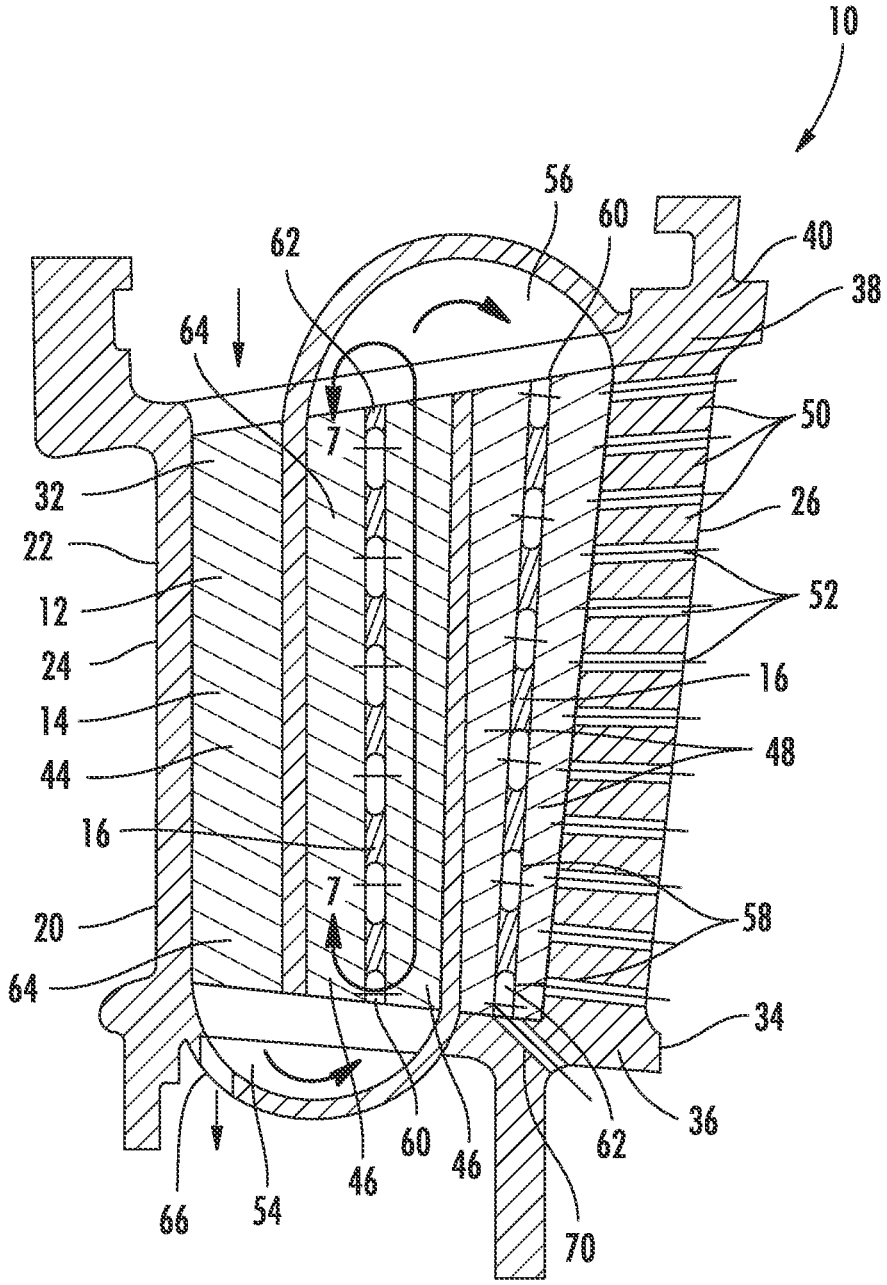
FIG. 4 is a cross-sectional view, also referred to as a filleted view, of the outer wall of the turbine vane taken at section line 4-4 in FIG. 1.
Figure 5:
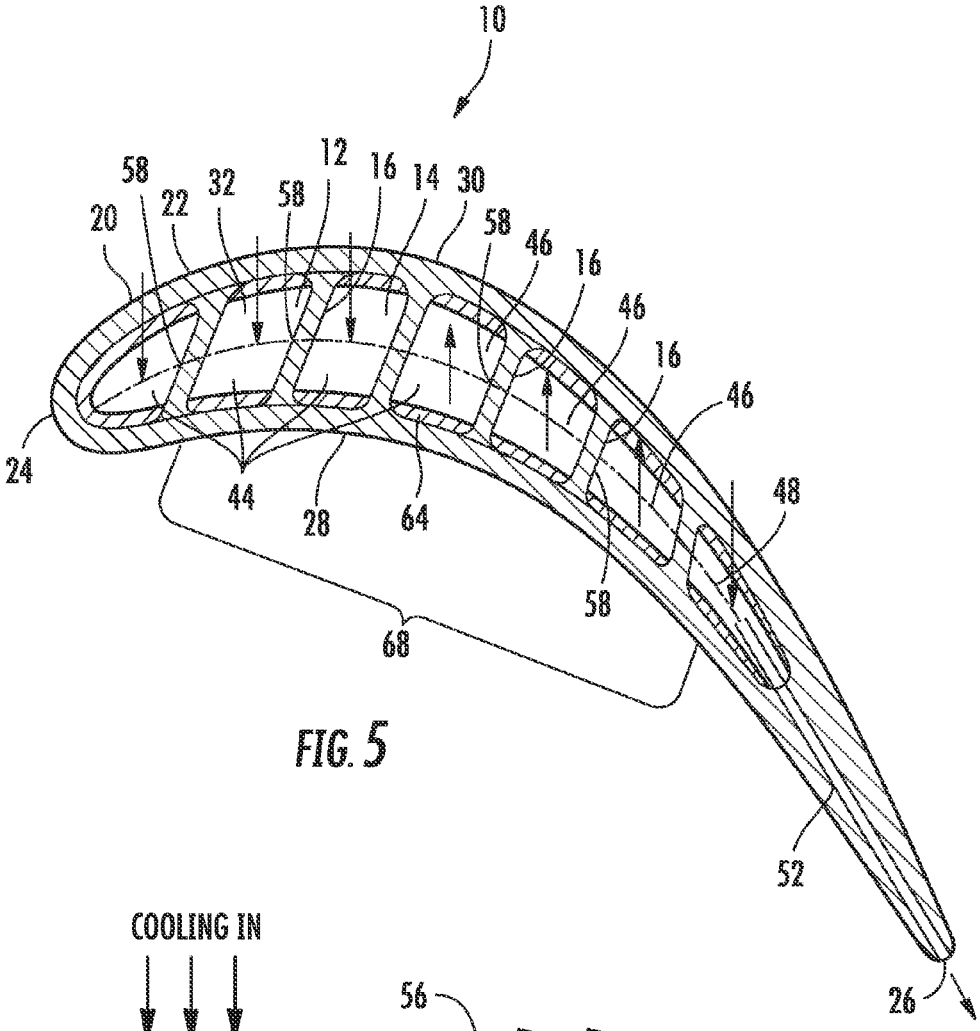
FIG. 5 is a cross-sectional view of an alternative configuration of the turbine vane taken at section line 5-5 in FIG. 1.

As shown in FIG. 1, the turbine vane 10 may have any appropriate configuration and, in at least one embodiment, may be formed from a generally elongated airfoil 20 formed from an outer wall 22, and having a leading edge 24, a trailing edge 26, a pressure side 28, a suction side 30 generally opposite to the pressure side 28, a first endwall 34 at a first end 36, a second endwall 38 at a second end 40 opposite the first end 36, and an internal cooling system 12 positioned within the generally elongated airfoil 20 and formed from at least one chamber 32. As shown in FIGS. 2, 4 and 5, the internal cooling system 12 may include at least one serpentine cooling channel 14 positioned in the internal aspects of the turbine vane 10. The serpentine cooling channel 14 may extend through only a portion of the turbine vane 10 or may extend throughout the turbine vane 10, such as from the ID 36 to the OD 40, as shown in FIG. 4.

The turbine vane 10 may include one or more serpentine cooling channels 14 positioned in the internal cooling system 12. The serpentine cooling channel 14 may extend from the pressure side 28 to the suction side 30 of the turbine vane 10. The serpentine cooling channel 14 may be a triple pass cooling channel that is formed from a first pass 44 coupled to a second pass 46 that is coupled to a third pass 48. The first and third passes 44, 48 are generally aligned such that the first and third passes 44, 48 pass fluids in the same direction that is generally opposite to the direction of fluid flow in the second pass 46 that connects the first pass 44 to the third pass 48. The first pass 44 may be positioned closest to the leading edge 24, and the third pass 48 may be positioned closest to the trailing edge 26. In one embodiment, as shown in FIG. 4, the serpentine cooling channel 14 extends between the ID 36 and the OD 40. The first pass 44 shares a wall forming the leading edge 24, and the third pass 38 is positioned in close proximity to the trailing edge 26 and in contact with ribs 50 forming trailing edge exhaust orifices 52. The first and second passes 44, 46 may be coupled together with a turning manifold 54. The turning manifold 54 may include a bypass orifice 66. The turning manifold 54 may be positioned in the ID 36, as shown in FIG. 4. The second and third passes 46, 48 may be coupled together with a turning manifold 56 that may be positioned in the OD 40, as shown in FIG. 4. An exhaust outlet 70 may extend from the third pass 48 through the outer wall 22 for film cooling.

Figure 3:
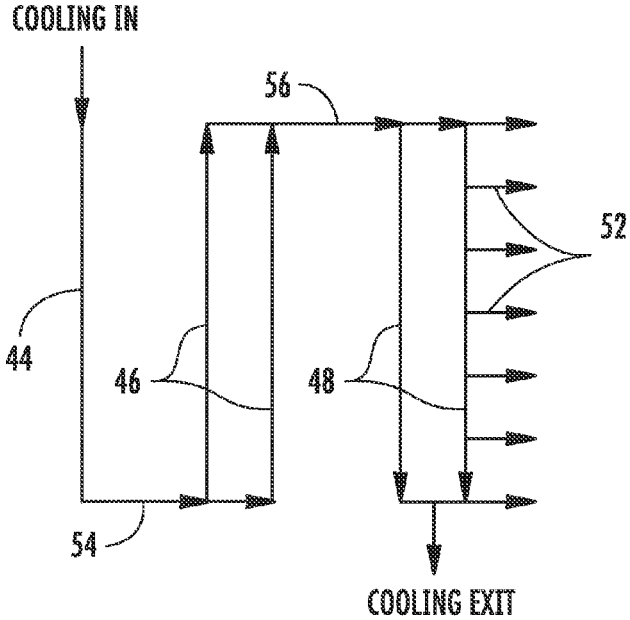
FIG. 3 is a schematic view of the flow of cooling fluids through the serpentine cooling channel shown in FIG. 2.
Figure 6:
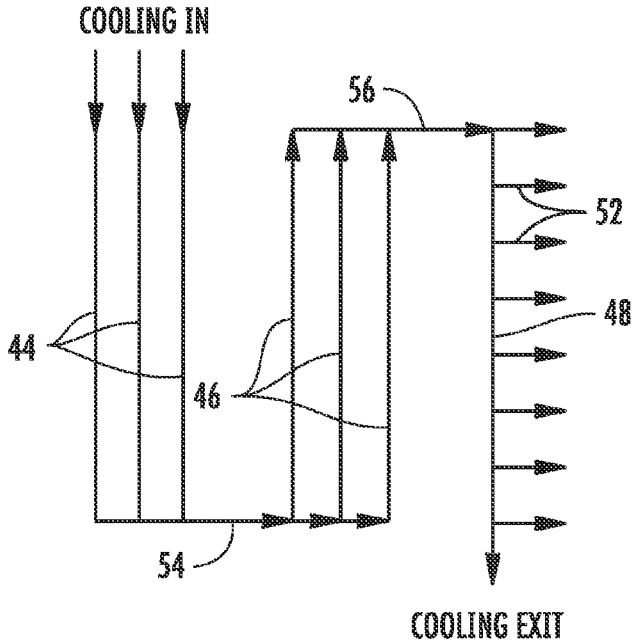
FIG. 6 is a schematic view of the flow of cooling fluids through the serpentine cooling channel shown in FIG. 5.
Figure 7:
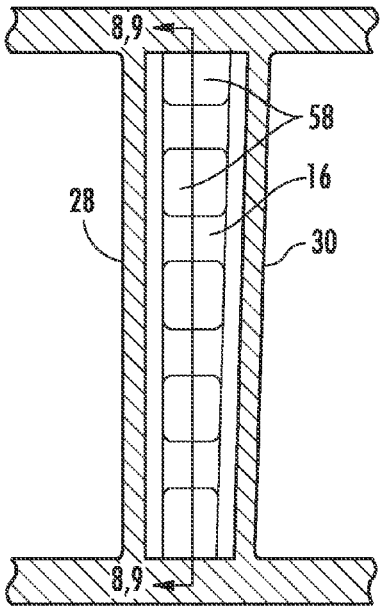
FIG. 7 is a partial detailed view of a flow blocker rib taken along section line 7-7 in FIG. 4.

The internal cooling system 12 may include one or more flow blocker ribs 16 position in the serpentine cooling channel 14. One or more of the flow blocker ribs 16 may be positioned in the one or more of the first, second and third passes 44, 46, 48. The second pass 46 may include one or more flow blocker ribs 16 extending generally from the turbine manifold 54 in the ID 36 to the turning manifold 56 in the OD 40. In another embodiment, the flow blocker ribs 16 may not extend into the turbine manifolds 54, 56. Rather, the flow blocker ribs 16 may be shorter. As shown in FIGS. 2 and 3, the third pass 48 may include one or more flow blocker ribs 16 extending longitudinally therein. In other embodiments, the internal cooling system 12 may include a plurality of flow blocker ribs 16 positioned in one or more passes 44, 46, 48. For instance, as shown in FIGS. 5 and 6, two flow blocker ribs 16 may be positioned in the first pass 44 and two blocker ribs 16 may be positioned in the second pass 46. It is not necessary that each of the passes 44, 46, 48 have the same number of flow blocker ribs 16. However, in some of the embodiments, a portion of the passes 44, 46, 48 include the same number of flow blocker ribs 16. As shown in FIG. 5, some of the flow blocker ribs 16 may extend nonorthogonally between the pressure side 28 and suction side 30. In other embodiment, a flow blocker rib 16 may extend generally orthogonal to an inner surface forming the pressure side 28 and the pressure side 30.

The flow blocker ribs 16 may include one or more flow blocker slots 58. The flow blocker slot 58 may have any appropriate shape and size. The flow blocker slot 58 may be configured as generally rectangular openings that place adjacent, concurrent cooling fluid flow paths in fluid communication with each other. The flow blocker slot 58 may also be configured to be a generally square opening. The flow blocker slots 58 may be equally spaced from each other, spaced in patterns, which may or may not be repeated, or randomly spaced from each other. The flow blocker slots 58 may extend from the inner surface of the pressure side wall 28 to the inner surface of the suction side wall 30. In other embodiments, the flow blocker slots 58 may be smaller in height.

Figure 8:
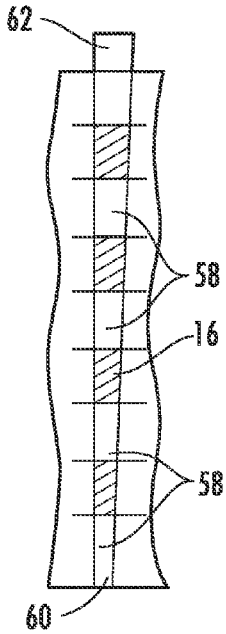
FIG. 8 is a cross-sectional view of a flow blocker rib taken at detail 8-8 in FIG. 7.
Figure 9:
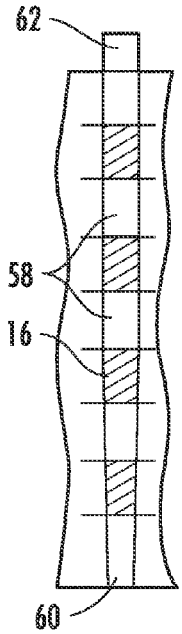
FIG. 9 is a cross-sectional view of another flow blocker rib taken at detail 9-9 in FIG. 7.

The flow blocker ribs 16 may be tailored to fit the particular heating load of each application and specific turbine vane design 10. In particular, to achieve a required reduction in cross-sectional flow area in the passes 44, 46, 48, the flow blocker ribs 16 may be tapered with a nonuniform width such that the leading edge 60 of the flow blocker rib 16 is narrower than the trailing edge 62. The flow blocker ribs 16 may have a nonuniform width with a uniform taper, as shown in FIG. 8, or may have a nonuniform width with a nonuniform taper, as shown in FIG. 9. The tapered flow blocker ribs 16 facilitate construction of the turbine vane 10 with some materials. The tapered flow blocker ribs 16 also create desirable internal channel flow areas and achieve through flow Mach numbers for better tailoring external heat loads and design metal temperatures.

The cooling system 12 may also include one or more trip strips 64 positioned in the serpentine cooling channel 14. The trip strips 64 may be positioned on the inner surfaces of the pressure side 28 or the suction side 30, or both. The trip strips 64 may be positioned nonparallel and nonorthogonal to the flow of cooling fluids in the cooling system 12. The trip strips 64 may create vortices at each trip strip 64 that rotate along the trip strips 64. The flow blocker rib 16 may disrupt the vortices, thereby creating mixing of the cooling fluids and enhancing the thermal efficiency of the system.

The cooling system 12 may also include a plurality of trailing edge exhaust orifices 52 positioned between the third pass 48 and the trailing edge 26 to cool the material forming aspects of the turbine vane 10 proximate to the trailing edge 26. The trailing edge exhaust orifices 52 may have any appropriate configuration, such as, but not limited to, cylindrical and elliptical.

During use, cooling fluids, such as air, may be fed into the internal cooling system 12 through the first pass 44 proximate to the leading edge 24. The skewed trip strips 64 augment the internal heat transfer coefficient. A portion of the cooling fluids is bled off through the bypass orifice 66 in the turning manifold 54 into the inter-stage housing for cooling and purging rim cavities. The cooling fluids then pass through the reminder of the serpentine cooling channel 14, including: the second pass 46, the turning manifold 56, and the third pass 48 and is discharged through the trailing edge exhaust orifices 52 and the exhaust outlet 70. The cooling fluids cool the materials forming the trailing edge region proximate to the trailing edge 62 before being discharged.

When used in second and third row turbine vanes 10, the airfoil forming such vanes typically are long chord airfoils with large flow channels that yield low Mach numbers. The flow blocker ribs 16 are used specifically in the midchord region 68 of the airfoil 20 where the through flow region often becomes too large to maintain an adequate Mach number. With the use of the flow blocker rib 16, the serpentine cooling channel 14 is transformed from a single large flow channel into two or more small flow concurrent channels for maintaining the internal through flow channel Mach number. This configuration retains the large ceramic core for forming the triple pass serpentine cooling channel 14, which obtains a superior casting yield. In addition, the fact that the thickness for the internal flow blocker rib 16 can vary enables the flow blocker ribs 16 to be tailored for a specific fluid flow and for local metal temperature.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine vane for a gas turbine engine, comprising:

a generally elongated airfoil formed from an outer wall, and having a leading edge, a trailing edge, a pressure side, a suction side generally opposite to the pressure side, a first endwall at a first end, a second endwall at a second end opposite the first end, and an internal cooling system positioned within the generally elongated airfoil;

wherein the internal cooling system includes at least one internal chamber positioned within the generally elongated airfoil;

at least one serpentine cooling channel positioned in the internal chamber forming the internal cooling system and formed from at least a first pass, a second pass and a third pass, wherein the first and third passes pass cooling fluids in the same direction that is generally opposite to the second pass that connects the first pass to the third pass and wherein the first pass is positioned closest to the leading edge and the third pass is positioned closest to the trailing edge;

wherein the second pass includes at least one flow blocker rib extending longitudinally within the second pass; and wherein the flow blocker rib includes a plurality of flow blocker slots;

wherein the flow blocker rib has a nonuniform width and a nonuniform taper such that a leading edge of the flow blocker rib is narrower than a trailing edge of the flow blocker rib.

2. The turbine vane of claim 1, wherein the first, second and third passes extend from an inner diameter to an outer diameter of the turbine vane.

3. The turbine vane of claim 2, wherein the flow blocker rib extends from the inner diameter to the outer diameter.

4. The turbine vane of claim 1, wherein the at least one flow blocker rib extends from the outer wall forming the pressure side to the outer wall forming the suction side.

5. The turbine vane of claim 1, wherein third pass includes at least one flow blocker rib extending longitudinally within the third pass.

6. The turbine vane of claim 1, wherein the first pass includes at least one flow blocker rib extending longitudinally within the first pass.

7. The turbine vane of claim 6, wherein the first pass includes two flow blocker ribs extending longitudinally within the first pass.

8. The turbine vane of claim 7, wherein the second pass includes two flow blocker ribs extending longitudinally within the second pass.

9. The turbine vane of claim 1, further comprising a plurality of trailing edge cooling fluid exhaust orifices extending from the third pass to the trailing edge.

10. The turbine vane of claim 1, wherein the first pass includes a bypass orifice.

11. A turbine vane for a gas turbine engine, comprising:

a generally elongated airfoil formed from an outer wall, and having a leading edge, a trailing edge, a pressure side, a suction side generally opposite to the pressure side, a first endwall at a first end, a second endwall at a second end opposite the first end, and an internal cooling system positioned within the generally elongated airfoil;

wherein the internal cooling system includes at least one internal chamber positioned within the generally elongated airfoil;

at least one serpentine cooling channel positioned in the internal chamber forming the internal cooling system and formed from at least a first pass, a second pass and a third pass, wherein the first and third passes pass cooling fluids in the same direction that is generally opposite to the second pass that connects the first pass to the third pass and wherein the first pass is positioned closest to the leading edge and the third pass is positioned closest to the trailing edge;

wherein the first, second and third passes extend from an ID to an OD of the turbine vane;

wherein the second pass includes at least one flow blocker rib extending longitudinally within the second pass from the inner diameter to the outer diameter; and wherein the flow blocker rib includes a plurality of flow blocker slots, and the flow blocker extends from the outer wall forming the pressure side to the suction side forming the suction side;

wherein the flow blocker rib has a nonuniform width and a nonuniform taper such that a leading edge of the flow blocker rib is narrower than a trailing edge of the flow blocker rib.

12. The turbine vane of claim 11, wherein third pass includes at least one flow blocker rib extending longitudinally within the third pass.

13. The turbine vane of claim 11, wherein the first pass includes at least one flow blocker rib extending longitudinally within the first pass.

14. The turbine vane of claim 13, wherein the first pass includes two flow blocker ribs extending longitudinally within the first pass, and the second pass includes two flow blocker ribs extending longitudinally within the second pass.

15. The turbine vane of claim 11, wherein the first pass includes a bypass orifice.

16. The turbine vane of claim 11, further comprising a plurality of trailing edge cooling fluid exhaust orifices extending from the third pass to the trailing edge.

* * * * *